US009790005B2

(12) United States Patent
Sadiq et al.

(10) Patent No.: US 9,790,005 B2
(45) Date of Patent: Oct. 17, 2017

(54) PLASTIC CLOSURE WITH ENHANCED PERFORMANCE

(75) Inventors: Sohail Sadiq, Crawfordsville, IN (US); John Edie, Crawfordsville, IN (US); David E. Gevers, Crawfordsville, IN (US); William Moll, Crawfordsville, IN (US); Navaneeth Bashyam, Crawfordsville, IN (US); Pranav Bhatt, Crawfordsville, IN (US); Russ Tartock, Crawfordsville, IN (US)

(73) Assignee: Closure Systems International Inc., Crawfordsville, IN (US)

( * ) Notice: Subject to any disclaimer, the term of this patent is extended or adjusted under 35 U.S.C. 154(b) by 0 days.

(21) Appl. No.: 13/037,087

(22) Filed: Feb. 28, 2011

(65) Prior Publication Data

US 2012/0091138 A1 Apr. 19, 2012

Related U.S. Application Data

(60) Provisional application No. 61/393,438, filed on Oct. 15, 2010.

(51) Int. Cl.
*B65D 41/00* (2006.01)
*B65D 41/32* (2006.01)
(Continued)

(52) U.S. Cl.
CPC ..... *B65D 41/325* (2013.01); *B65D 41/04* (2013.01); *B65D 41/3428* (2013.01); *B65D 51/1661* (2013.01); *B65D 2101/003* (2013.01)

(58) Field of Classification Search
CPC ..... B65D 41/3423; B65D 41/3428; B65D 41/325; B65D 41/40; B65D 41/08; B65D 41/0457; B65D 41/0464; B65D 41/04
(Continued)

(56) References Cited

U.S. PATENT DOCUMENTS 2,010,228 A * 8/1935 Gibbs ..... B21D 51/50 413/23
4,270,664 A * 6/1981 Buono ..... 215/216
(Continued)

FOREIGN PATENT DOCUMENTS

EP 1 048 585 A2 11/2000
JP 58-113633 U 8/1983
(Continued)

OTHER PUBLICATIONS

International Search Report and Written Opinion for corresponding PCT application No. PCT/US2011/052326 mailed Feb. 9, 2012.
(Continued)

*Primary Examiner* — Anthony Stashick
*Assistant Examiner* — Ernesto Grano
(74) *Attorney, Agent, or Firm* — Nixon Peabody LLP

(57) ABSTRACT

A plastic closure embodying the principles of the present invention comprises a closure cap having a top wall portion, and an annular skirt portion depending from the top wall portion. The skirt portion includes an internal thread formation for threaded engagement with the external thread formation of an associated container. In order to facilitate high-speed application, and minimize the use of polymeric material, the closure is configured to exhibit a variation in retention force which decreases in a direction away from the top wall portion of the closure cap.

5 Claims, 6 Drawing Sheets

(51) Int. Cl.
*B65D 41/34* (2006.01)
*B65D 41/04* (2006.01)
*B65D 51/16* (2006.01)

(58) Field of Classification Search
USPC ..... 215/44, 329, 307, 303; 220/288, 260, 220/296
See application file for complete search history.

(56) References Cited

U.S. PATENT DOCUMENTS 4,382,521 A * 5/1983 Ostrowsky ..... 215/307
4,674,643 A 6/1987 Wilde et al.
4,798,303 A * 1/1989 Arnold ..... B65D 41/04 215/329
4,801,030 A 1/1989 Barriac
4,966,780 A 10/1990 Hargraves et al.
5,242,068 A * 9/1993 McCandless ..... B65D 41/3428 215/252
5,411,157 A * 5/1995 King et al. ..... 215/330
5,533,633 A 7/1996 King
5,638,972 A * 6/1997 Druitt ..... 215/344
6,006,930 A * 12/1999 Dreyer et al. ..... 215/44
6,213,321 B1 4/2001 Zumbuhl
7,694,835 B1 * 4/2010 Montgomery ..... B65D 41/045 215/329
2002/0166834 A1 11/2002 Branson et al.
2005/0263476 A1 12/2005 Harrison et al.
2008/0035602 A1 2/2008 Gooden et al.

FOREIGN PATENT DOCUMENTS

JP H09-226790 9/1997
JP 2007-145341 6/2007
JP 2008-007130 1/2008
JP 2009-107704 5/2009
WO WO 03/016161 A1 2/2003

OTHER PUBLICATIONS

English Translation of JP2008-007130.
Extended European Search Report for EPO Application No. EP 11 83 2971 dated Nov. 10, 2016 (8 pages).

* cited by examiner

PLASTIC CLOSURE WITH ENHANCED PERFORMANCE

CROSS-REFERENCE TO RELATED APPLICATIONS

This application claims priority of provisional application Ser. No. 61/393,438, filed Oct. 15, 2010, entitled "Improved Lightweight Closure Construction", which is hereby incorporated by reference.

FEDERALLY SPONSORED RESEARCH OR DEVELOPMENT

Not Applicable.

MICROFICHE/COPYRIGHT REFERENCE

Not Applicable.

TECHNICAL FIELD

The present invention relates generally to plastic closures formed from polymeric materials, such as for use on beverage containers and the like, and more particularly to a plastic closure configured for enhanced high-speed application, wherein the closure is configured to exhibit a variation in retention force which decreases in a direction away from a top wall portion of the closure.

BACKGROUND OF THE INVENTION

Plastic closures formed from thermoplastic polymeric materials have met with widespread acceptance in the marketplace for use on containers having beverages and like products. Closures of this type, which can be efficiently formed by compression molding or injection molding, are typically configured for threaded application to associated containers, and are further configured to engage and cooperate with the container to effectively seal the container's contents. Closures of this type may be configured as so-called composite closures, including an outer closure cap or shell, and an inner sealing liner, or a so-called "linerless" closure, where the closure cap itself is configured to provide the desired sealing cooperation with the associated container.

While closures of the above type have been very commercially successful, versatile and economic use of these types of closures has been promoted by reducing the amount of polymeric material required for forming each closure, that is, making each closure more lightweight. However, in this regard, certain dimensional considerations become important. In particular, closures of this nature are typically applied to associated containers by high-speed, automatic capping equipment, including capping heads or chucks which rotatably fit each internally threaded closure to an associated, externally threaded container. While weight savings in such closures can be desirably achieved by reducing the thickness of the side wall portion of the closure, it will be appreciated that the use of such automated capping equipment typically requires that the outside diameter of the skirt portion of the closure fall within a certain specified range. In other words, for application to a given configuration of container neck, or "finish", the outside diameter of this skirt portion is essentially fixed.

As will be appreciated, reducing the weight of a closure by reducing the thickness of the side wall or skirt portion will necessarily result in increased clearance between the inside of the skirt portion, and an associated container finish, given that the outside diameter of the skirt portion is predetermined. However, the increased clearance between the inside surface of the skirt portion and the associated container finish must be accommodated in order to achieve efficient closure application, as well as the desired sealing and performance characteristics for the closure.

An additional consideration relates to enhancing high-speed closure application. High-speed application ordinarily requires that the internal thread formation of the closure mate properly and efficiently with the external thread formation of the associated container. It is particularly desirable to avoid misapplication or "cocked" closures, which can undesirably interrupt the efficient high-speed application.

Currently, closures are applied to containers by rotating the closures until the closure/container thread interactions draw the closure down, causing the seal feature of the closure to contact the extreme upper rim of the container finish. There are occasionally issues where the closure thread does not engage the container thread properly, causing misapplied closures. This is especially the case with containers with more than one thread start. When this occurs, the closure has the tendency to be damaged when application is complete, or by being cocked on the container finish, which can undesirably impair sealing performance.

To address this, the closure threads can be made smaller so that with top loading, the closure thread can more easily jump over the container thread on application, and correct the tendency to cock. However, when this is done, it becomes easier to strip the closure during application, resulting in damaged threads, large variation of application angle, and therefore impairment of sealing performance. Additionally, the smaller closure thread can cause issues in pressurized applications, where the internal pressure within the container can cause the closure thread to jump over the container thread, and cause the closure to be released from the container finish.

The present closure has been particularly configured to minimize the use of polymeric material from which the closure is formed, while at the same time facilitating high-speed application with automatic capping equipment.

SUMMARY OF THE INVENTION

A plastic closure embodying the principles of the present invention has been particularly configured for light weight, while providing the desired performance characteristics, and facilitating high-speed application. In particular, this is achieved by configuring the closure such that the retention force of the closure with respect to the associated container decreases in a direction away from the top wall portion of the closure cap. As will be further described, this desirably facilitates high-speed application, while desirably reducing the quantity of polymeric material required for closure formation.

In certain illustrated embodiments, the diameter of the closure thread is varied, from a large diameter on the open end, for better application, to a small diameter on the closed end, for better strip torque and package pressure performance. In one illustrated embodiment, central lines of thread segments of the closure are staggered so that at the closed end of the closure there is even thread contact with the container thread, without cocking.

In accordance with the illustrated embodiments, a plastic closure embodying the principles of the present invention comprises a closure cap having a top wall portion, and an annular skirt portion depending from the top wall portion. The skirt portion of the closure cap has an internal thread formation for threaded engagement with an external thread formation of an associated container.

As noted, the present closure is configured such that the retention force created by the internal thread formation decreases in a direction away from the top wall portion of the closure cap. By such an arrangement, high-speed application is facilitated, while minimizing the polymeric material required for closure formation.

In one illustrated embodiment, this variation in retention force is provided by configuring the internal thread formation of the closure cap to define a plurality of thread profiles. The thread formation includes a thread profile having a relatively large cross-sectional area positioned closer to the top wall portion, than another one of the thread profiles having a relatively small cross-sectional area. Notably, the centerlines of the plurality of thread profiles are non-helical, or staggered, with the plurality of thread profiles collectively defining a helical engagement surface for engagement with the external thread formation of the associated container.

In this embodiment, thread depths are varied to improve application in strip torque, without adding too much weight to the closure. The thread segments are staggered for allowing seal contact to be even around the container, and to maintain the closure in a level orientation with respect to the container. This allows better application line efficiencies for packages, while still allowing the closure to meet product performance requirements.

In a preferred embodiment, the inside surface of the skirt portion of the closure cap defines at least one axially extending gas-venting groove, with the internal thread formation interrupted where the groove intersects the thread formation. In order to facilitate high-speed application, and avoid cross-threading of the closure threads and container threads, at least one of the axially extending gas-venting grooves can be provided with an axially extending projection spaced from opposite side edges of the gas-venting groove. The projection intersects at least a portion of the internal thread formation for engagement with the external thread formation of the associated container, thus provided resistance to closure wobbling or like movement during application, which can undesirably result in cross-threading. The provision of such axially extending projections desirably facilitates reducing the weight of the closure.

In another aspect of the present invention, the variation in the retention force created by the internal thread formation of the closure is provided by configuring the thread formation to define a plurality of thread profiles, including a thread profile having a relatively large cross-sectional area positioned closer to the top wall portion than another one of the thread profiles having a relatively small cross-sectional area. The inside surface of the skirt portion defines at least one axially extending gas-venting groove. At least an uppermost portion of the internal thread formation, positioned most closely adjacent to the top wall portion of the closure cap, is interrupted where the gas-venting groove intersects the thread formation. In accordance with this aspect of the present invention, the relatively large cross-sectional portion of the thread formation can be provided by a relatively deeper thread profile, again so that the retention force provided by the internal thread formation decreases in a direction away from the top wall portion. In a further embodiment, the portion of the internal thread formation having a relatively large cross-sectional area is provided by a relatively wide thread profile. In accordance with this aspect of the present invention, it is contemplated that the plurality of thread segments which provide the internal thread formation collectively define a non-helical engagement surface, which can be configured to optimize container pressures to facilitate efficient high-speed operation, while achieving the desired closure performance, including the necessary retention force to create acceptable strip torque for the closure.

In another aspect of the present invention, the variation in retention force created by the internal thread formation of the closure cap is achieved by providing the thread formation with at least one of: (1) at least one reinforcing element; and (2) a region of relatively reduced thread cross-sectional area, so that the retention force provided by the thread formation decreases in a direction away from the top wall portion. In accordance with this aspect of the present invention, the reinforcing element comprises a reinforcing rib extending between an inside surface of the skirt portion, and the thread formation beneath an engagement surface of the thread formation. The region of reduced thread cross-sectional area is defined by a recess in the thread formation beneath an engagement surface of the thread formation.

In a further aspect of the present invention, the desired reduction in retention force is created by decreasing the thickness of the skirt portion of the closure cap in a direction away from the top wall portion, while configuring the exterior of the skirt portion to be substantially cylindrical, and dimensioned for proper cooperation with an associated capping head or chuck. In this aspect of the present invention, the internal thread formation of the closure cap can be provided with a substantially uniform cross section, with the inside surface of the skirt portion defining at least one axially extending gas-venting groove, with the internal thread formation being interrupted where the groove intersects the thread formation.

Other features and advantages of the present invention will become readily apparent from the following detailed description, the accompanying drawings, and the appended claims.

DETAILED DESCRIPTION OF THE PREFERRED EMBODIMENT

Figure 1:
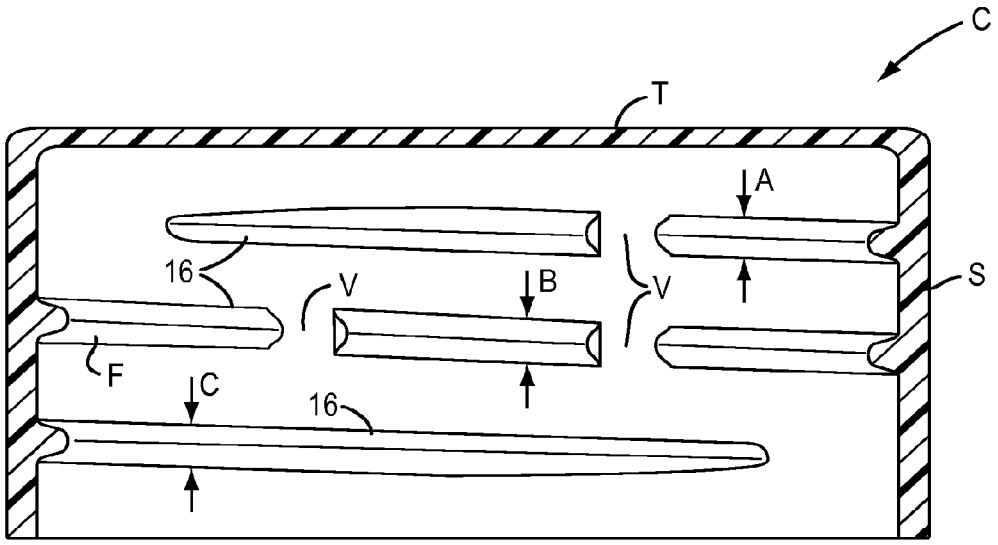
FIG. 1 (Prior Art)
FIG. 1 is a diagrammatic view of a plastic closure having an internal thread formation having a substantially uniform cross-sectional area, and a plurality of axially extending gas-venting grooves.

While the present invention is susceptible of embodiment in various forms, there is shown in the drawings and will hereinafter be described presently preferred embodiments, with the understanding that the present disclosure is to be considered as an exemplification of the invention, and is not intended to limit the invention to the specific embodiments illustrated.

With reference first to FIG. 1, therein is illustrated a closure C showing typical features of a closure formed from polymeric material. Closure C includes a top wall portion T, and an annular, depending skirt portion S, having an internal thread formation F configured for threaded cooperation with an external thread formation on the neck of an associated container to which the closure is applied. In order to facilitate venting of gas pressure from within a container such as containing carbonated contents, the closure C is configured to include a plurality of axially extending gas-venting grooves V, which interrupt the thread formation F, such as illustrated.

Features of this typical closure construction will be noted, including the skirt portion S having a substantially uniform thickness, and the thread formation F having a substantially uniform thread depth, and a substantially uniform thread width, as indicated at A, B and C.

Figure 2:
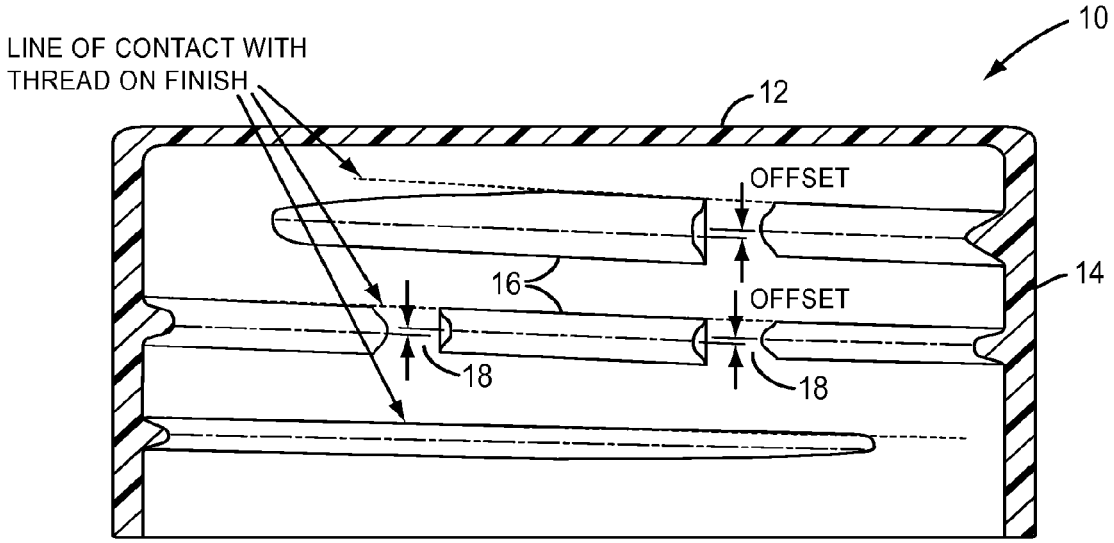
FIG. 2 is a diagrammatic view similar to FIG. 1 illustrating a plastic closure embodying the principles of the present invention, wherein the internal thread formation comprises a plurality of thread segments having non-helical centerlines.

With reference now to FIG. 2, there is illustrated a closure 10 embodying the principles of the present invention. As discussed hereinabove, closure 10 can be efficiently formed from polymeric materials, such as by injection molding or compression molding. It is contemplated that closure 10 is configured to provide the desired sealing cooperation with an associated container, while at the same time being configured to minimize the use of polymeric material, while facilitating high-speed application to an associated container.

Closure 10 includes a closure cap including a top wall portion 12, and an annular skirt portion 14 depending from top wall portion 12 and extending around a central axis. The closure can be provided with a separate sealing liner adjacent the inside surface of top wall portion 12, or may otherwise be configured as a "linerless" closure, including one or more sealing features formed integrally with the inside surface of top wall portion 12 for sealing cooperation with the neck portion of an associated container.

In accordance with the present invention, the closure 10 has been configured to exhibit a variation in the retention force on the associated container, which decreases in a direction away from top wall portion 12 of the closure cap. In this embodiment, this variation in retention force is achieved by configuring the internal thread formation 16 of the closure cap such that the retention force created by the thread formation decreases in a direction away from top wall portion 12.

In particular, the internal thread formation 16 is defined by a plurality of thread profiles, including a thread profile having a relatively large cross-sectional area positioned closer to top wall portion 12, then another one of the thread profiles having a relatively small cross-sectional area as viewed in a plane containing the central axis of the closure 10. This is evident from FIG. 2, where it will be observed that segments of the thread formation 16, interrupted by axially extending gas-venting grooves 18, decrease in cross-sectional area in a direction away from top wall portion 12. Thus, the material required for formation of the closure is desirably reduced, at the same time reducing the retention force of the thread formation in a direction away from the top wall portion. This configuration has been found to desirably facilitate high-speed application to an associated container, with those portions of the thread formation closest to the top wall portion 12 exhibiting the necessary hoop strength and retention force so that the closure exhibits the desired "strip torque" attendant to threaded application to an associated container.

Notably, the desired sealing cooperation with an associated container is achieved in this embodiment by configuring the centerlines of the segments of the thread formation 16 to be non-helical, or staggered, as illustrated by the offset relationship of the centerlines, as seen in FIG. 2, with the thread segments collectively defining a helical engagement surface for engagement with the external thread formation of the associated container. It is believed if the diameter of thread formation is varied, from a large diameter at the open end of the closure (for better application), to a small diameter at the closed end (for better strip torque performance), without changing the centerline, the natural contact between the closure and container thread will tend to cock the closure once fully applied. To resolve this, the centerlines are non-helical and staggered for the different thread profiles, so that at the closed end of the thread there is even contact with the container thread, without cocking.

Figure 3:
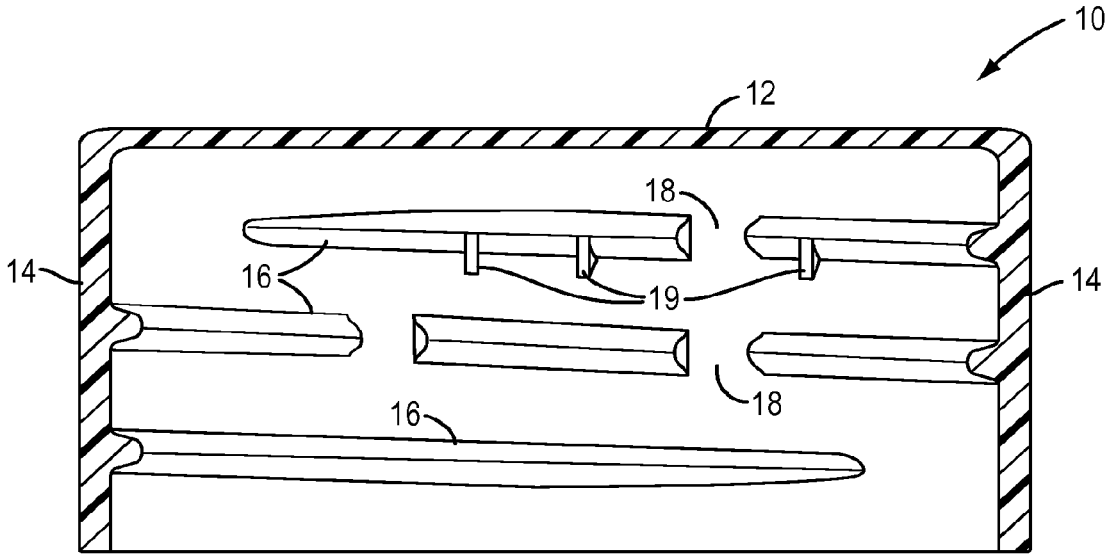
FIG. 3 is a diagrammatic view of a plastic closure illustrating a further aspect of the present invention, wherein a portion of the internal thread formation is provided with a plurality of reinforcing elements.

As noted, a closure embodying the principles of the present invention is configured such that the retention force created by the internal thread formation of the closure cap decreases in a direction away from the top wall portion of the closure. FIG. 3 illustrates an embodiment of the present invention which achieves this variation in a thread formation comprised of a plurality of segments, wherein the cross-sectional area and configuration of the thread segments is substantially uniform. In particular the thread formation 16 of closure 10 illustrated in FIG. 3 has the desired variation in retention force by the provision of at least one reinforcing element, which in the illustrated embodiment comprises one or more reinforcing ribs 19 which extend between an inside surface of skirt portion 14 and the thread formation 16, beneath an engagement surface of the thread formation.

Figure 4:
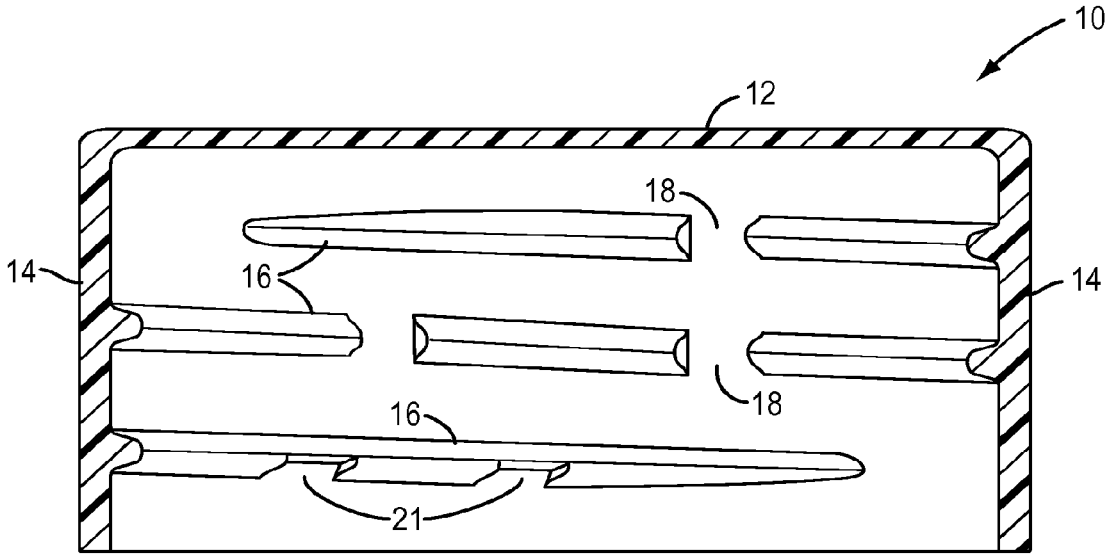
FIG. 4 is a further diagrammatic view illustrating an embodiment of the present closure, wherein the retention force of portions of the internal thread formation are reduced by the provision of regions having a reduced cross-sectional area.

FIG. 4 illustrates an embodiment of the present closure, wherein the desired variation in retention force is provided by configuring the thread formation 16 to include a region of relatively reduced thread cross-sectional area. As illustrated, each region of reduced thread cross-sectional area is defined by a recess 21 in the thread formation, beneath an engagement surface of the thread formation.

In each of the embodiments of FIGS. 3 and 4, axially extending gas-venting grooves 18 are provided, thus facilitating the release of gas pressure from within an associated container, such as containing carbonated contents, during closure removal.

Figure 5:
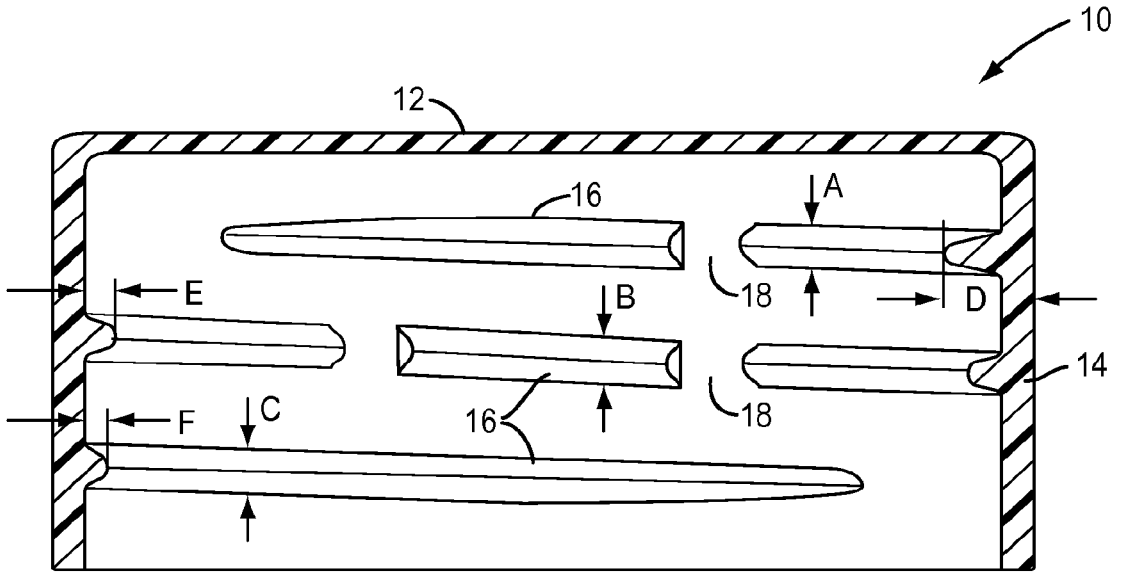
FIG. 5 is a further diagrammatic view illustrating a plastic closure embodying the principles of the present invention, wherein the internal thread formation of the closure cap has a portion of relatively large cross-sectional area, provided by a relatively deep thread profile.
Figure 6:
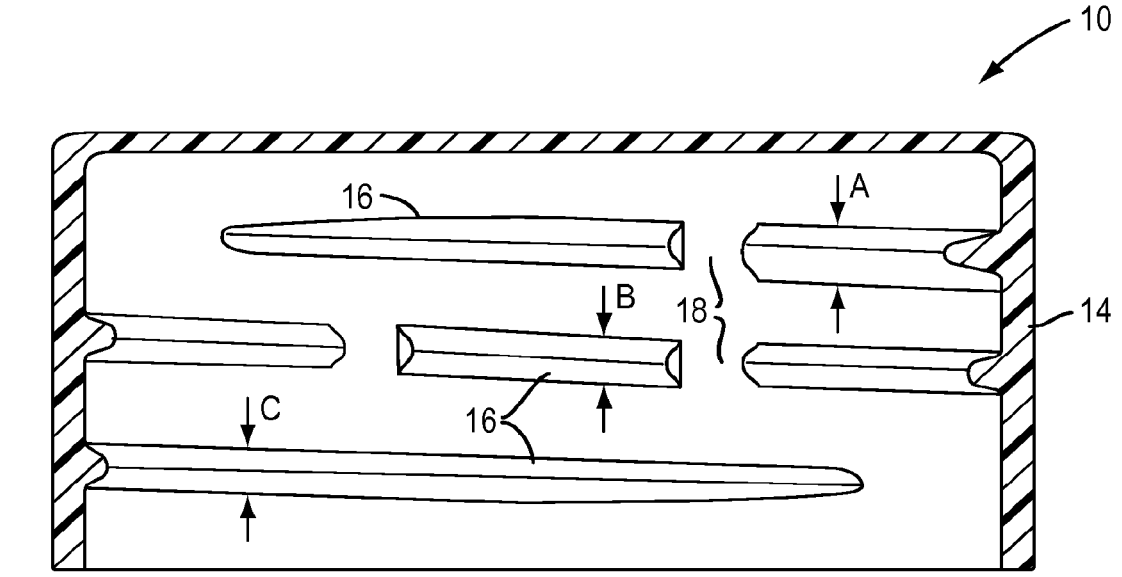
FIG. 6 is a further diagrammatic view of the closure embodying the principles of the present invention, wherein the internal thread formation as a portion of relatively large cross-sectional area provided by a relatively wide thread profile.

FIGS. 5 and 6 illustrate embodiments of the present invention, wherein the desired variation and the retention force created by internal thread formation 16 is achieved by the thread formation being defined by a plurality of thread profiles, including a thread profile having a relatively large cross-sectional area positioned closer to the top wall portion 12 than another one of the thread profiles having a relatively small cross-sectional area. In the embodiment of FIG. 5, this difference in the cross-sectional areas of the thread formation 16 is provided by providing at least one portion of the thread profile closer to top wall portion 14 with a relatively deeper thread profile, to define a relatively reduced inside diameter for the thread formation at that region. In FIG. 5, dimensions A, B and C illustrate the constant width of the profile, while dimensions D, E and F show the decreasing depth of the thread profile. In the embodiment of FIG. 6, the portion of the thread profile having a relatively large cross-sectional area is provided by a relatively wide thread profile, so that the retention force provided by the internal thread formation decreases in a direction from the top wall portion. In FIG. 6, the variation in dimensions A, B and C show the decreasing width of the thread profile.

In each of the embodiments of FIGS. 5 and 6, axially extending gas-venting grooves 18 are provided, including in an uppermost portion of each illustrated internal thread formation, positioned most closely adjacent to top wall portion 12, which is interrupted where the gas-venting groove 18 intersects the thread formation 16.

Figure 7:
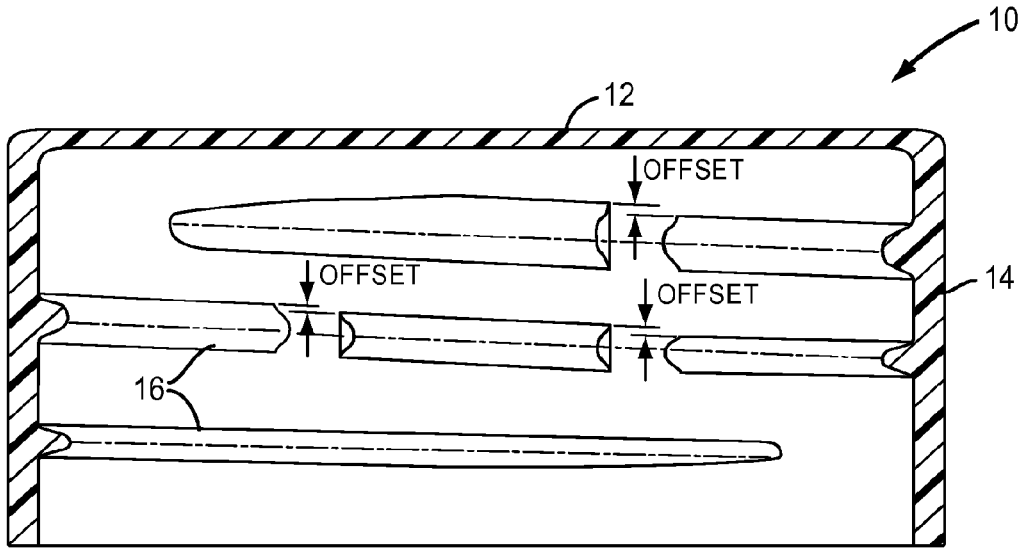
FIG. 7 is a diagrammatic view of a closure embodying the principles of the present invention, wherein a thread formation having a non-uniform cross-sectional area comprises thread segments which collectively define a non-helical engagement surface.

The embodiment of FIG. 7 of the present invention contemplates the desired variation in the retention force of the closure cap by decreasing the cross-sectional area of the internal thread formation 16 in a direction away from the top wall portion 12. In this embodiment, contact with the associated container is optimized such as by configuring the segments of the thread formation 16 to collectively define a non-helical, or staggered, engagement surface, as illustrated by the offset in successive ones of the thread segments, arranged so that the centerlines of the thread segments are helical.

Figure 8:
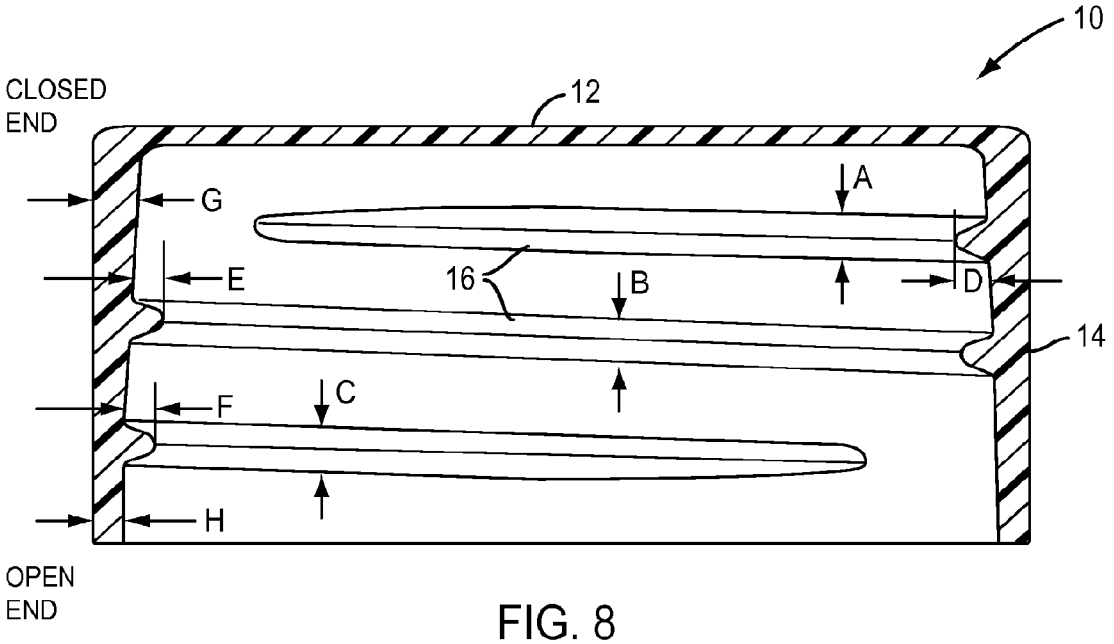
FIG. 8 is a further diagrammatic view of a closure embodying the principles of the present invention, wherein the retention force provided by the internal thread formation of the closure is varied by decreasing the thickness of the skirt portion of the closure cap in a direction away from the top wall portion.

FIG. 8 illustrates an embodiment of the present invention wherein the desired variation in the retention force of the closure cap is achieved by decreasing the thickness of skirt portion 14 in a direction away from top wall portion 12, in order to provide the closure with the retention force which decreases in a direction away from the top wall portion. In this embodiment, the exterior of the skirt portion 16 is provided with a substantially cylindrical configuration, dimensioned for cooperation with conventional capping heads or trucks.

The decrease in the thickness of the skirt portion 14 is illustrated by comparison of dimensions G and H in FIG. 8, while dimensions A, B and C illustrate the constant width of the thread formation. Dimensions D, E and F show that notwithstanding the substantially constant thread depth, the effective inside diameter of the thread formation increases in a direction away from top wall portion 12, thus achieving the desired variation in the retention force in a direction away from the top wall portion.

Figure 9:
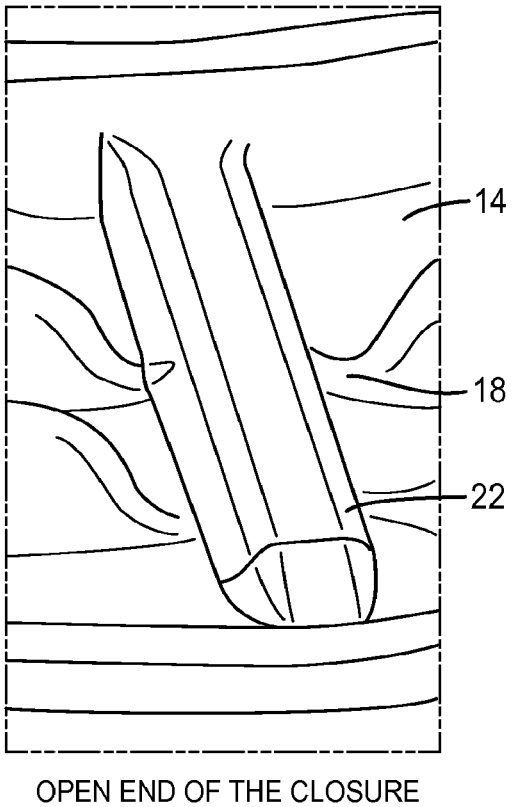
FIG. 9 is a relatively large, diagrammatic view illustrating an axially extending projection or rib provided in an axially extending gas-venting groove of the skirt portion of the closure cap.

FIG. 9 illustrates a feature of the present invention to facilitate high-speed application of the present closure to an associated container. In particular, FIG. 9 illustrates the provision of an axially extending projection 22 respectively positioned in one of the gas-venting grooves 18 defined by the skirt portion 14 of the present closure. Notably, projection 22 is configured to engage and cooperate with the external thread formation of an associated container, attendant to closure application, thereby desirably stabilizing the closure and preventing undesired cocking or cross-threading of the closure as it is applied to the associated container.

Figure 10:
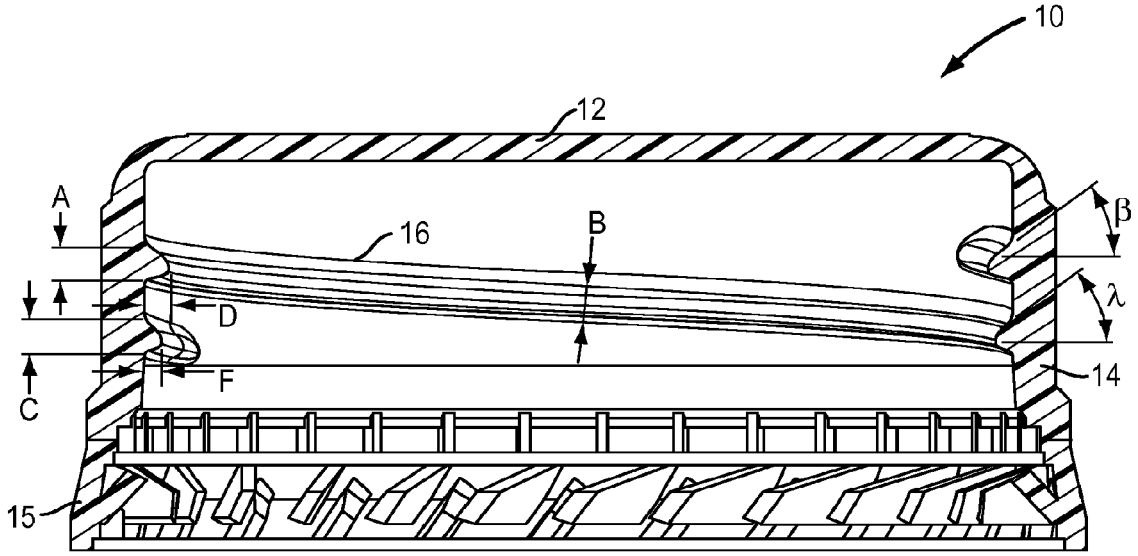
FIG. 10 is a further diagrammatic of a further embodiment of a closure embodying the principle of the present invention.

FIG. 10 is a diagrammatic view of a further embodiment of a closure embodiment of the principles of the present invention, wherein the closure 10 includes a closure cap having a top portion 12 and an annular skirt portion 14 depending from the top wall portion 12. In this illustrated embodiment, the closure 10 includes a tamper-evident pilfer band 15 at least partially detachably connected to the skirt portion 14.

As in previous embodiments, the skirt portion 14 of the closure 10 includes an internal thread formation 16 for threaded engagement with an external thread portion of an associated container. In accordance with the present invention, the internal thread formation 16 is configured to exhibit a variation in retention force which decreases in a direction away from top wall portion 12, with the thread formation being configured to define a plurality of thread profiles, including a thread profile having a relatively large cross-sectional area positioned closer to the top wall portion and another one of the thread profiles having a relatively small cross-sectional area.

In this embodiment, at least a portion of the thread formation 16 has a continuously varying thread profile cross section, which in the illustrated embodiment varies continuously throughout the length of the thread formation. The centerlines of a plurality of the thread profiles may be either helical, or smoothly, non-helical, with the plurality of thread profiles collectively defining a helical engagement surface for engagement with the external thread formation of the associated container. As illustrated in FIG. 10, the upper engagement surface can be configured at an angle "beta," which is equal to a lower engagement surface angle "lambda." In this embodiment, the cross-sectional area of the thread formation 16 gradually decreases in a direction away from top wall portion 12, in that dimension "A" is greater than dimension "B," which is greater than dimension "C," with the thread formation thus gradually decreasing in width in a direction away from top wall portion 14. In addition, thread formation 16 is configured with a decreasing depth in that dimension "D" is greater than dimension "F."

The thread width and height continuously vary from a wide/tall cross section at the closed end of the closure, proximal to top wall portion 12, to a narrow/thin cross section at the open end of closure, distal from the top wall portion. By this arrangement, wherein the thread formation may have a helical centerline, or a smoothly varying centerlines, the retention characteristics of the closure can be infinitely varied, thus permitting the closure to be configured for any desired application. As in previous embodiments, one or more discontinuities in the thread formation may be provided to facilitate gas venting, such as for use on containers having carbonated beverages, however, for containers having non-carbonated contents, a continuous thread formation can be advantageously employed. By this configuration, it is within the purview of the present invention to provide the thread formation with a helical engagement surface, with the centerline of the thread formation also being helically configured, but at a pitch different from that of the helical engagement surface.

From the foregoing, it will be observed that numerous modifications and variations can be affected without departing from the true spirit and scope of the novel concept of the present invention. It will be understood that no limitation with respect to the specific embodiments illustrated herein is intended or should be inferred. The disclosure is intended to cover, by the appended claims, all such modifications as fall within the scope of the claims.

What is claimed is:

1. A plastic closure, comprising:

a closure cap having a top wall portion, and an annular skirt portion depending from said top wall portion, said skirt portion of said closure cap having an internal thread formation for threaded engagement with an external thread formation of an associated container, said internal thread formation comprising a plurality of thread segments, wherein said internal thread formation is configured to exhibit a variation in retention force which decreases in a direction away from said top wall portion of said closure cap, said thread formation having an upper portion, and a lower portion having a region of relatively reduced cross-sectional area compared to a cross-sectional area of said upper portion, said region of relatively reduced thread cross-sectional area defined by a discrete recess in one of said thread segments of said thread formation beneath a surface of said thread segment that faces upwardly to engage a downwardly facing thread surface on an external thread formation of an associated container, so that the retention force provided by said thread formation decreases in a direction away from said top wall portion.

2. A plastic closure, comprising:

a closure cap having a top wall portion, and an annular skirt portion depending from said top wall portion, said skirt portion of said closure cap having: a) an internal reference surface with an internal thread formation projecting radially inwardly therefrom for threaded engagement with an external thread formation of an associated container; and b) a radially outwardly facing surface, said internal reference surface and the internal thread formation defining an effective inside diameter of the internal thread formation, wherein a portion of said skirt portion of said closure cap adjacent to, positioned radially outwardly of, and vertically overlapping with, said internal thread formation decreases in thickness and thereby creates an increase in the effective inside diameter of the internal thread formation in a direction away from said top wall portion in order to provide said closure with a retention force which decreases in a direction away from said top wall portion, wherein the radially outwardly facing surface has a substantially constant diameter.

3. A plastic closure in accordance with claim 2, wherein said internal thread formation has a substantially uniform cross section.

4. A plastic closure in accordance with claim 2, wherein an inside surface of said skirt portion defines at least one axially extending gas-venting groove, said internal thread formation being interrupted where said groove intersects said thread formation.

5. The plastic closure according to claim 2, wherein the skirt portion defines a radially outermost part of the closure cap.

* * * * *